US006069549A

United States Patent [19]

Heritier-Best

[11] Patent Number: 6,069,549

[45] Date of Patent: May 30, 2000

[54] WINDING, PARTICULARLY FOR A HIGH-VOLTAGE IGNITION COIL CIRCUIT

[75] Inventor: Pierre Heritier-Best, Orbeil, France

[73] Assignee: Sagem S.A., Paris, France

[21] Appl. No.: 09/147,588

[22] PCT Filed: Aug. 5, 1997

[86] PCT No.: PCT/FR97/01450

§ 371 Date: Mar. 18, 1999

§ 102(e) Date: Mar. 18, 1999

[87] PCT Pub. No.: WO98/06114

PCT Pub. Date: Feb. 12, 1998

[30] Foreign Application Priority Data

Aug. 7, 1996 [FR] France ..... 96 09955

[51] Int. Cl.[7] ..... H01F 27/28; H01F 29/00

[52] U.S. Cl. ..... 336/190; 336/70; 336/222

[58] Field of Search ..... 336/190, 70, 220, 336/222, 223

[56] References Cited

U.S. PATENT DOCUMENTS

| | | | |
|---|---|---|---|
| 2,256,730 | 9/1941 | Frazier | 336/220 |
| 4,794,361 | 12/1988 | Young | 336/222 |
| 5,736,917 | 4/1998 | Kawano et al. | 336/190 |

FOREIGN PATENT DOCUMENTS

| | | | |
|---|---|---|---|
| 196451 | 3/1938 | European Pat. Off. | 336/190 |
| 0518 737 A1 | 6/1992 | European Pat. Off. | 336/223 |
| 145675 | 9/1921 | United Kingdom | 336/70 |

*Primary Examiner*—Michael L. Gellner
*Assistant Examiner*—Anh Mai
*Attorney, Agent, or Firm*—Dennison, Scheiner, Schultz & Wakeman

[57] ABSTRACT

A process for producing a coil of wire formed at least partially of substantially frustoconical plies of wires laid against one another in a continuous fashion. Wire is first wound onto a core in a first direction over a first length L which is less than the length of the core. Winding continues in the opposite direction over a second length $L-d_1$ which is less than length L by an amount $d_1$, and winding then continues in the first direction over a third length $(L-d_1)+d_2$ which is greater than said second length $L-d_1$ by an amount $d_2$. Winding then continues in the same manner until the desired number of plies is obtained.

7 Claims, 2 Drawing Sheets

WINDING, PARTICULARLY FOR A HIGH-VOLTAGE IGNITION COIL CIRCUIT

BACKGROUND OF THE INVENTION

The present invention relates to a coil, especially for a high-voltage ignition coil circuit.

It is known that, in spark ignition internal combustion engines, the combustion of the gas mixture in the cylinder is caused by the spark which is produced between the electrodes of an ignition spark plug.

In order to produce this spark, the terminals of the spark plug are connected to the ends of the secondary (high-voltage) winding of a transformer such as an ignition coil, the primary winding of which is connected to a voltage supply via a switch such as a transistor.

When this switch is closed, an electric current flows in the primary winding. If, at a given instant the switch is then opened, a sudden overvoltage is produced in the primary winding. This generates, by induction, a voltage surge in the secondary winding. When this voltage reaches a sufficient value, a spark is produced which ignites the fuel mixture.

Since the voltage across the terminals of the secondary may reach several tens of thousands of volts, various arrangements have already been proposed in order to limit the risk of forming a spark between two turns of this winding. In general, provision is made for this winding to be wound on a holder comprising a tubular winding core and a plurality of fins perpendicular to the axis of the core. The fins between them define annular winding compartments, the bottom of each compartment being formed by the core and each fin having a passage for allowing the wire of the secondary winding to pass from one compartment to the adjacent compartments.

Various measures have already been proposed for improving this arrangement.

Thus, document EP A 0,375,502 provides isolating compartments between the winding compartments so as to increase the distance between the turns of two successive winding compartments. However, this arrangement has the drawback of increasing the axial size of the secondary winding holder.

It has also been proposed, in document EP-A-0,609,109, to give the core a shape such that the passage from one compartment to the adjacent compartment runs into the upstream compartment at a certain distance from the core and into the downstream compartment level with this core. Thus, near the passage, the windings of two adjacent compartments are offset so that it is possible to limit the voltage between two turns arranged opposite each other.

These arrangements give results which are generally satisfactory but which at the present time, however, have a drawback. This is because attempts are being made more and more to increase the voltage across the terminals of the secondary and, for this to be done, consequently to increase the number of turns in this winding. Moreover, given that attempts are being made to ensure that it still has a small diameter, it must necessarily be greater in length.

At the same time, it is not desirable, in order to limit the cost of the coil, to increase the number of fins and therefore of winding compartments. The latter are therefore being made wider and wider.

One is therefore confronted with a problem of flow of the plies of wires and of mixing of the turns.

SUMMARY OF THE INVENTION

The present invention aims to remedy these drawbacks.

For this purpose, the subject of the invention is firstly a coil, especially for a high-voltage ignition coil circuit, characterized in that it is formed, at least partly, by approximately frustoconical plies of wires, these plies being laid against one another in a continuous fashion.

According to the invention, a coil is therefore produced on a holder without any fins. It will be seen below that, by virtue of the arrangement of the plies in the from of truncated cones, according to the invention, the risks of forming sparks between the turns are considerably reduced.

In one particular embodiment, each ply is formed by a plurality of turns in series, going from at least one smaller-diameter turn to at least one larger-diameter turn and vice versa.

Also according to one particular embodiment, at least one ply is linked by its smaller-diameter turn to the smaller-diameter turn of one of the adjacent plies and by its larger-diameter turn to the larger-diameter turn of the other adjacent ply.

The subject of the invention is also a process for producing a coil as described above, comprising the steps consisting in:

a) winding a wire onto a holder in a first direction and over a first length;

b) continuing to wind the said wire in the other direction over a second length which is less than the said first length;

c) continuing to wind the said wire in the other direction over a third length which is greater than the said second length; and d) repeating steps b) and c) until the desired number of turns has been obtained, each step b) being carried out over a length of less than that of the steps c) which come before and after it in the succession of steps.

In one particular method of implementation, all steps b) are carried out over the same length.

Also according to one particular method of implementation, all steps c) are carried out over the same length.

BRIEF DESCRIPTION OF THE DRAWINGS

Two particular embodiments of the invention will now be described by way of non-limiting example with reference to the appended drawings in which.

DESCRIPTION OF THE PREFERRED EMBODIMENTS

Figure 1:
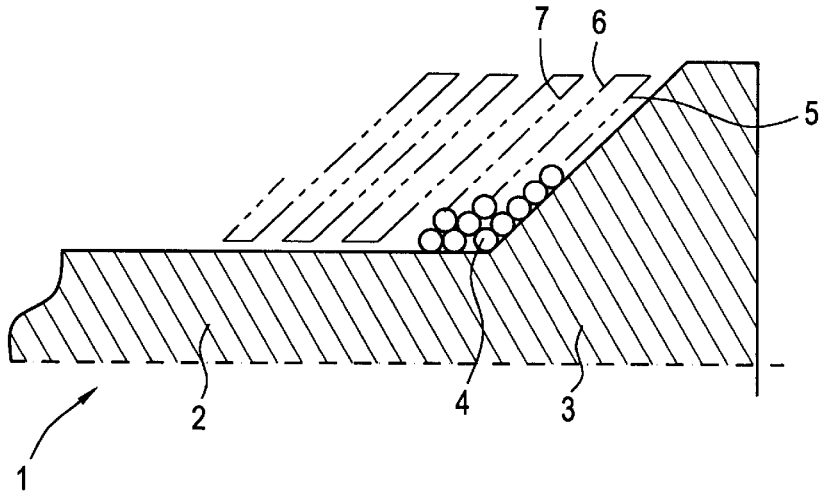
FIG. 1 is a schematic representation of a first embodiment.

FIG. 1 shows, in axial section, one end 1 of a high-voltage winding holder of an ignition coil. This holder has a cylindrical central part 2 and at least one frustoconical end part 3. The frustoconical part 3 is joined to the cylindrical part 2 by its small-diameter base.

The wire 4 starts to be wound at the junction between the parts 2 and 3. Winding continues over the part 3 towards the outside of the coil, both axially and radially. Thus, a first frustoconical ply of wires 5, applied to the part 3 of the holder, is formed.

After this first step, winding continues radially and axially towards the inside of the holder in order to form a second frustoconical ply 6, resting against the ply 5.

On reaching the part 2 of the holder, the winding continues with a third frustoconical ply 7 resting against the ply 6, and so on.

It may therefore be seen that the plies 5, 6, 7, etc. are laid against one another in series. The ply 6 is connected to the ply 5 which proceeds it by the larger-diameter turns of each of its plies. Likewise, the ply 6 is connected to the ply 7 which follows it by the two smaller-diameter turns of each of these two plies.

Figure 2:
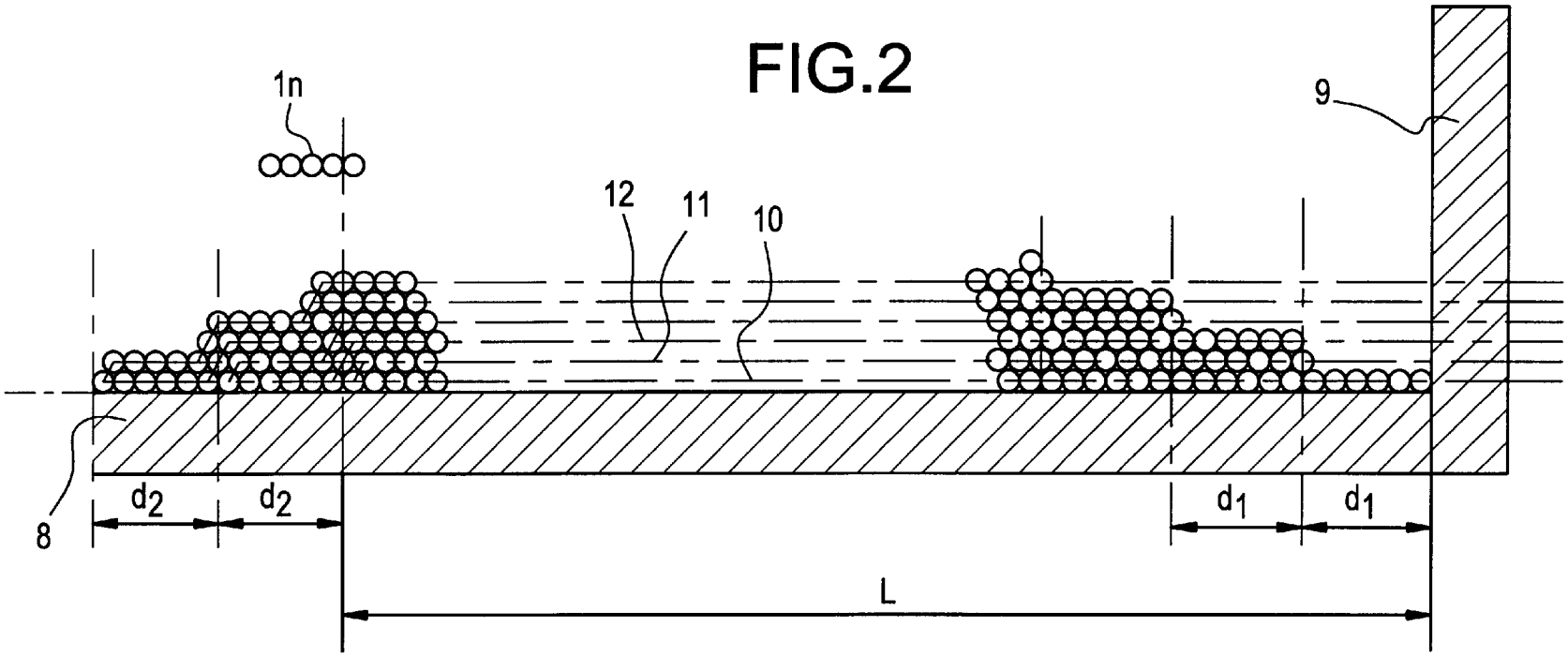
FIG. 2 illustrates a second embodiment.

FIG. 2 shows one winding method which avoids the use of a holder with a frustoconical end.

A conventional holder is used here, this having a cylindrical hub 8 and an end flange 9 perpendicular to the hub.

The winding of the wire starts here at one of the axial ends of the hub 8, in contact with the flange 9. A firstbase layer 10 is wound, going from the flange 9 to the center of the holder over a length L.

The winding continues in the reverse direction, that is to say towards the flange 9, over a length which is less than L, i.e. $L-d_1$, in order to form a second layer which is interrupted before the flange 9.

The coil resumes in the first direction, namely towards the center of the holder, in order to form a third winding layer over a length which is greater than $L-d_1$. This third layer, of length $L-d_1+d_2$, therefore extends towards the central part of the holder, beyond the base layer and the first layer, and is therefore, over this part of length $d_2$, in contact with hub 10 of the holder.

This procedure continues, each even layer being wound in FIG. 2 from right to left by moving away from the flange 9, until it extends beyond the previous layers by a length $d_2$, and each odd pair being wound from left to right by moving towards the flange 9 and being stopped at a distance $d_1$ from the start of the previous layer.

It $d_1=d_2$, the "steady state" will be achieved with the nth layer 1n where:

$$n=\left(\frac{L}{d_1}\times 2\right)-1$$

Figure 3:
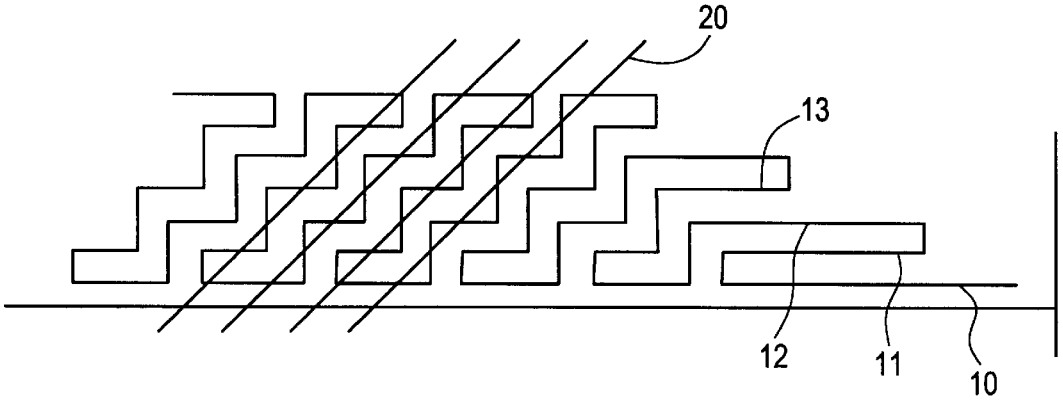
FIG. 3 is a schematic diagram of the embodiment shown in FIG. 2.

It may thus be seen in the schematic FIG. 3 that, in the "steady state", the plies of wires 20 are organized in truncated cones inoide one another.

It will be understood (something which is not apparent in FIG. 3 given its schematic character) that a normal cross section of the winding cuts n frustoconical plies, half of which has a number of wires corresponding to a winding length of L and the other half of which has a number of wires corresponding to a winding length of $L\cdot d_4$.

The maximum radial potential difference within the coil is equal to the potential difference between the last turn of the first layer and the first turn of the last layer in such a cross section. Assuming that a coil has 18,300 turns for a total potential difference of 40 kV, with a wire having a diameter of 0.072 mm, L=7 mm, and $d_1=d_2-0.86$ mm, it will be noted that n=15 and that the maximum potential difference corresponds to that of 1365 turns, i.e. 3 kV for a potential difference between two layers of 380 V.

In practice, these values are quite acceptable so that, by virtue of the invention, it has been possible to solve the problem of increasing the number of fins on a long coil.

What is claimed is:

1. A process for producing a coil of wire, formed at least partially of substantially frustoconical plies of wires laid against one another in a continuous fashion, comprising the steps of:

a) winding a wire onto a core of known length in a first direction over a first length L which is less than the length of the core;

b) continuing to wind said wire in a direction opposite to said first direction over a second length $L-d_1$, which is less than length L by an amount $d_1$;

c) continuing to wind said wire in the first direction over a third length $(L-d_1)+d_2$ which is greater than said second length $L-d_1$ by an amount $d_2$;

d) repeating steps b) and c) until a desired number of turns has been obtained, each said step b) being carried out over a length which is less than that of all preceding steps c) and all subsequent steps c).

2. A process according to claim 1, wherein all said steps b) are carried out over the same length $L-d_1$.

3. A process according to claim 1, wherein all said steps c) are carried out over the same length $(L-d_1)+d_2$.

4. A process according to claim 1, wherein the core comprises a generally cylindrical portion over which the winding takes place, and a transverse base portion joined to said generally cylindrical portion at one end thereof.

5. A process according to claim 4, wherein the winding in step a) begins at the junction of the generally cylindrical portion and the base portion.

6. A process according to claim 1, wherein $d_1=d_2$.

7. A process according to claim 6, wherein the winding is carried out over n plies, where $n=(2L/d_1)-1$.

* * * * *